US005620147A

United States Patent [19]

Newton

[11] Patent Number: 5,620,147

[45] Date of Patent: Apr. 15, 1997

[54] CONTINUOUS MEDIA MILL

[75] Inventor: Mitchel D. Newton, South Haven, Mich.

[73] Assignee: Epworth Manufacturing Co., Inc., South Haven, Mich.

[21] Appl. No.: 539,114

[22] Filed: Oct. 4, 1995

[51] Int. Cl.[6] ..... B02C 17/16

[52] U.S. Cl. ..... 241/171; 241/172

[58] Field of Search ..... 241/171, 172

[56] References Cited

U.S. PATENT DOCUMENTS

| | | | |
|---|---|---|---|
| 4,582,266 | 4/1986 | Entrikin et al. . | |
| 4,684,072 | 8/1987 | Nelson et al. . | |
| 4,730,189 | 3/1988 | Geiger | 241/172 X |
| 4,739,936 | 4/1988 | Stehr | 241/172 X |
| 4,746,069 | 5/1988 | Entrikin et al. . | |
| 4,856,717 | 8/1989 | Kamiwand et al. | 241/172 X |

FOREIGN PATENT DOCUMENTS 1254000 11/1967 Germany .

*Primary Examiner*—Mark Rosenbaum

*Attorney, Agent, or Firm*—Flynn, Thiel, Boutell & Tanis, P.C.

[57] ABSTRACT

A continuous type media mill for effecting in a particulate-containing substance, a reduction in size of the particulate. The mill includes a support and an elongate vessel mounted on the support. The vessel has a generally cylindrical interior. An inlet port to the interior of the vessel is provided as is an outlet port for the particulate-containing substance. Comminuting media is provided in the interior of the vessel, the media having a tendency to move toward the outlet port with the particulate-containing substance flowing through the vessel. A rotor extends centrally in the cylindrical interior of the vessel and along a majority of the length thereof. The rotor has a diameter substantially less than the inner cylindrical surface of the vessel to define a space therebetween. The rotor includes a plurality of blades spaced axially along the length thereof for flinging the media radially outwardly in response to a rotation of a driven shaft for the rotor. Structure is provided in the vessel for effecting a movement of the comminuting media toward the inlet port to the vessel in response to a rotation of the driven shaft to counter the aforesaid tendency of the media migrating with the particulate-containing substance toward the outlet port.

11 Claims, 2 Drawing Sheets

CONTINUOUS MEDIA MILL

FIELD OF THE INVENTION

This invention relates to a rotor construction for use in comminuting a particulate-containing substance to effect a reduction in the size of the particulate therein.

BACKGROUND OF THE INVENTION

Many devices are known for effecting a reduction in the size of a particulate in a particulate-containing substance. One such device is disclosed in U.S. Pat. No. 4,684,072, assigned to the same assignee as is the present invention. The aforesaid patent and the prior art listed therein will reveal various structures that have been employed over the years to effect an agitation of the comminuting media to effect the desired result. Each of these various structures provides varying degrees of sheer forces and impact forces for effecting the desired reduction in size of the particulate.

It is frequently desirable to cause particle size reduction of a solid contained in a liquid. Liquids are frequently wanted and desired in the total product system. For example, liquids tend to replace undesirable gases held by the particle. Further, more uniform particle size distribution is obtainable with liquid additions and a desired reaction or bond may even be created. However, in continuous type mills, that is, mills wherein a product is continuously introduced into the comminuting vessel at one end and the comminuted mixture or product is removed at the opposite end, a strong desire has existed for many years in providing apparatus which would quickly process the product flowing therethrough so as to increase the productivity of the mill. However, the length of time that the product remains in the mill is directly related to the particle size of the particulate desired in the output mixture or product. Further, considerable energy is consumed during the period of time that the mill is in operation. Thus, the cost of energy per unit of product can be greatly diminished if the amount of product being processed through the mill can be substantially increased. It has been discovered that the construction of the rotor has a direct influence on the efficiency of the mill.

In addition to the subject matter disclosed in U.S. Pat. No. 4,684,072 mentioned above, Applicant also wishes to make of record U.S. Pat. Nos. 4,582,266 and 4,746,069, all of which are assigned to the same assignee as is the present invention. Reference to the aforesaid three patents is to be incorporated herein by reference.

In instances where a particulate is contained within a liquid, as the liquid and particulate move through the mill, there is a tendency on the part of the liquid and particulate to carry the comminuting media along therewith toward the outlet from the mill. As a result, and eventually, a majority of the media will have migrated toward and congregated around the outlet from the mill thereby making the mill operate inefficiently and consume a great deal of energy.

Accordingly, it is an object of this invention to provide a mill for continuously processing product, wherein the comminuting media is sufficiently agitated and with a minimum of friction occurring between the moving parts to achieve the desired amount of comminution of a particulate-containing product and without effecting a migration of the media toward the outlet end of the comminuting vessel.

It is a further object of the invention to provide a continuous type mill, namely, a mill wherein product is introduced at one end of the vessel and the comminuted mixture or product removed at the opposite end, wherein the comminuting media is sufficiently agitated and with a minimum of friction occurring between the moving parts to achieve the desired amount of comminution of a particulate-containing product and without effecting a migration of the media toward the outlet end of the comminuting vessel.

It is a further object of the invention to provide a rotor having structure thereon which causes the media to move upstream against the flow of the liquid and particulate moving through the comminuting vessel to counter the tendency of the liquid and particulate to carry the media toward the outlet end of the vessel.

It is a further object of the invention to provide a continuous type mill wherein the media is maintained evenly distributed throughout the length of the comminuting vessel even when liquid and particulate is flowing from the inlet end toward the outlet end.

It is a further object of this invention to provide a mill, as aforesaid, wherein an increase in the amount of the comminuted mixture or product is effected while simultaneously reducing the energy consumed in comminuting the product per unit of product produced.

It is a further object of this invention to provide a mill, as aforesaid, which is durably constructed and which will provide a generally maintenance-free operating characteristic.

SUMMARY OF THE INVENTION

In general, the objects and purposes of the invention are met by providing a continuous type media mill for effecting in a particulate-containing substance, a reduction in size of the particulate. The mill includes a support and an elongate vessel mounted on the support. The vessel has a generally cylindrical interior. An inlet to the interior of the vessel is provided as is an outlet for the particulate-containing substance. Comminuting media is provided in the interior of the vessel, the media having a tendency to move toward the outlet with the particulate-containing substance flowing through the vessel. A rotor extends centrally in the cylindrical interior of the vessel and along a majority of the length thereof. The rotor has a diameter substantially less than the inner cylindrical surface of the vessel to define a space therebetween. The rotor includes a plurality of blades spaced axially along the length thereof for flinging the media radially outwardly in response to a rotation of a driven shaft for the rotor. Structure is provided on the rotor for effecting a movement of the comminuting media toward the inlet to the vessel in response to a rotation of the driven shaft to counter the aforesaid tendency of the media migrating with the particulate-containing substance toward the outlet.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figures 1, 2:
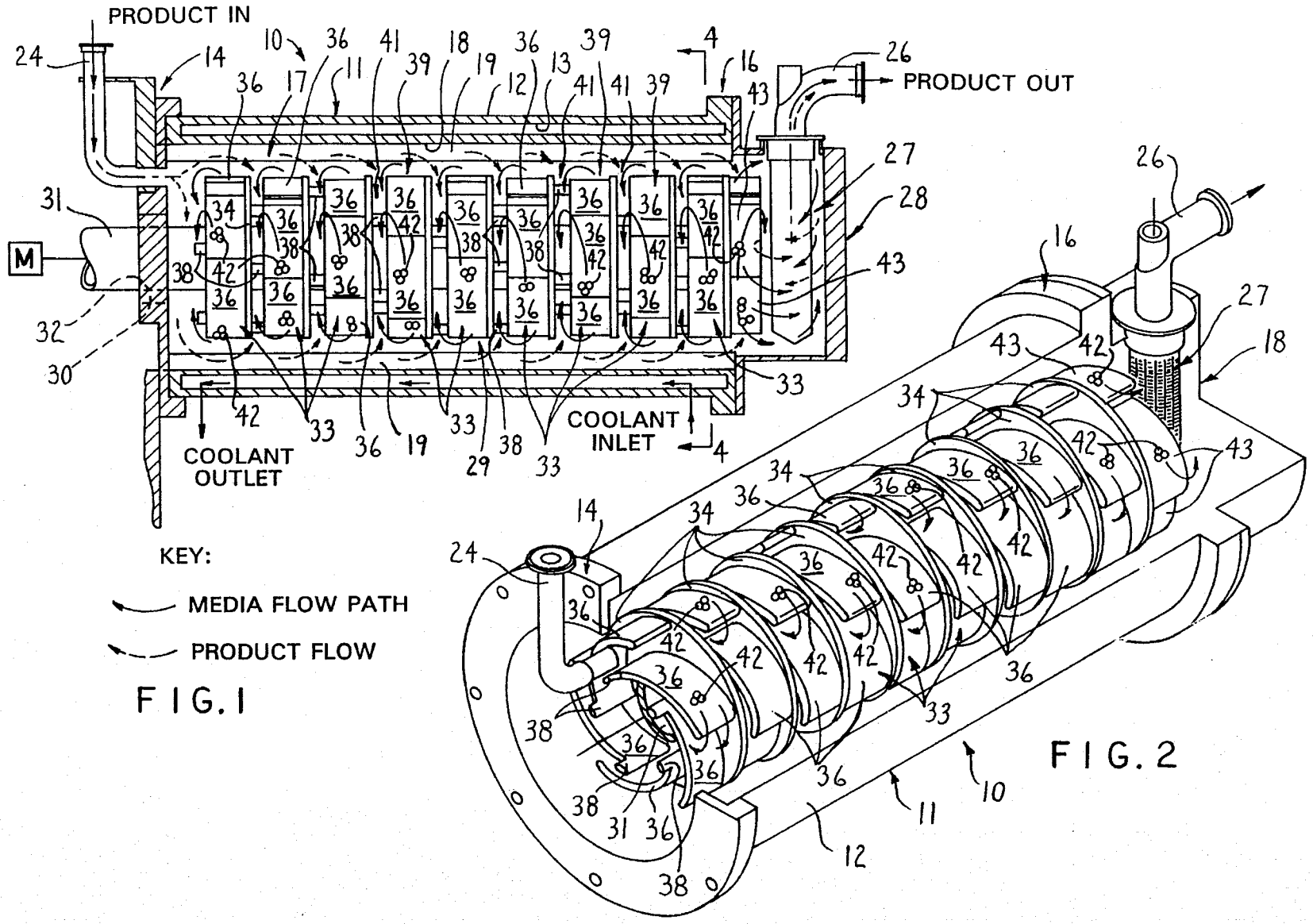
FIG. 1 is a central longitudinal sectional view of a continuous type mill embodying the invention.
FIG. 2 is an enlarged schematic isometric view of the mill illustrated in FIG. 1 and from the inlet end thereof.

Certain terminology will be used in the following description for convenience and reference only and will not be limiting The words "up" "down" "right" and "left" will designate directions in the drawings to which reference is made. The words "upstream" and "downstream" will refer to directions of flow of the particulate-containing substance, a flow from "upstream" toward the "downstream" being from the product inlet toward the product outlet. The words "in" and "out" will refer to directions toward and away from, respectively, the geometric center of the device and designated parts thereof. Such terminology will include the words above specifically mentioned, derivatives thereof and words of similar import.

Figure 4:
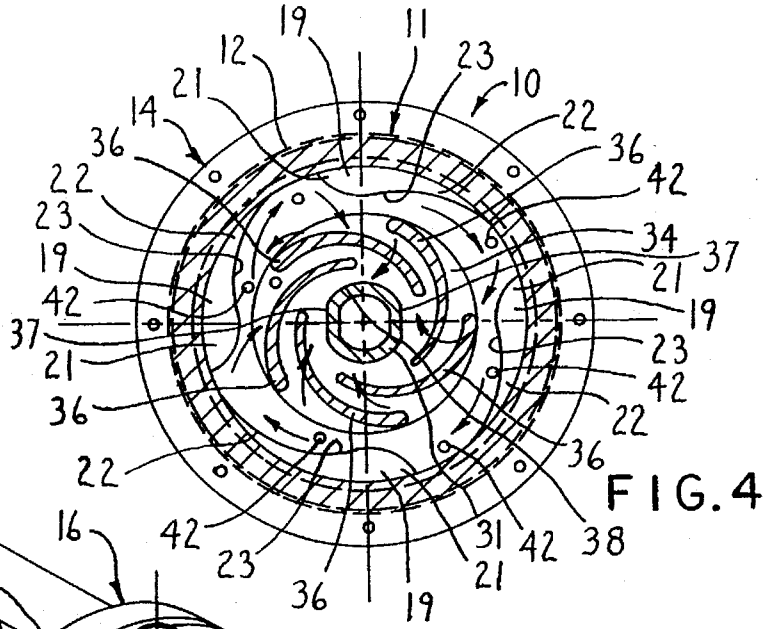
FIG. 4 is a sectional view taken along the line 4—4 of FIG. 1.
Figure 3:
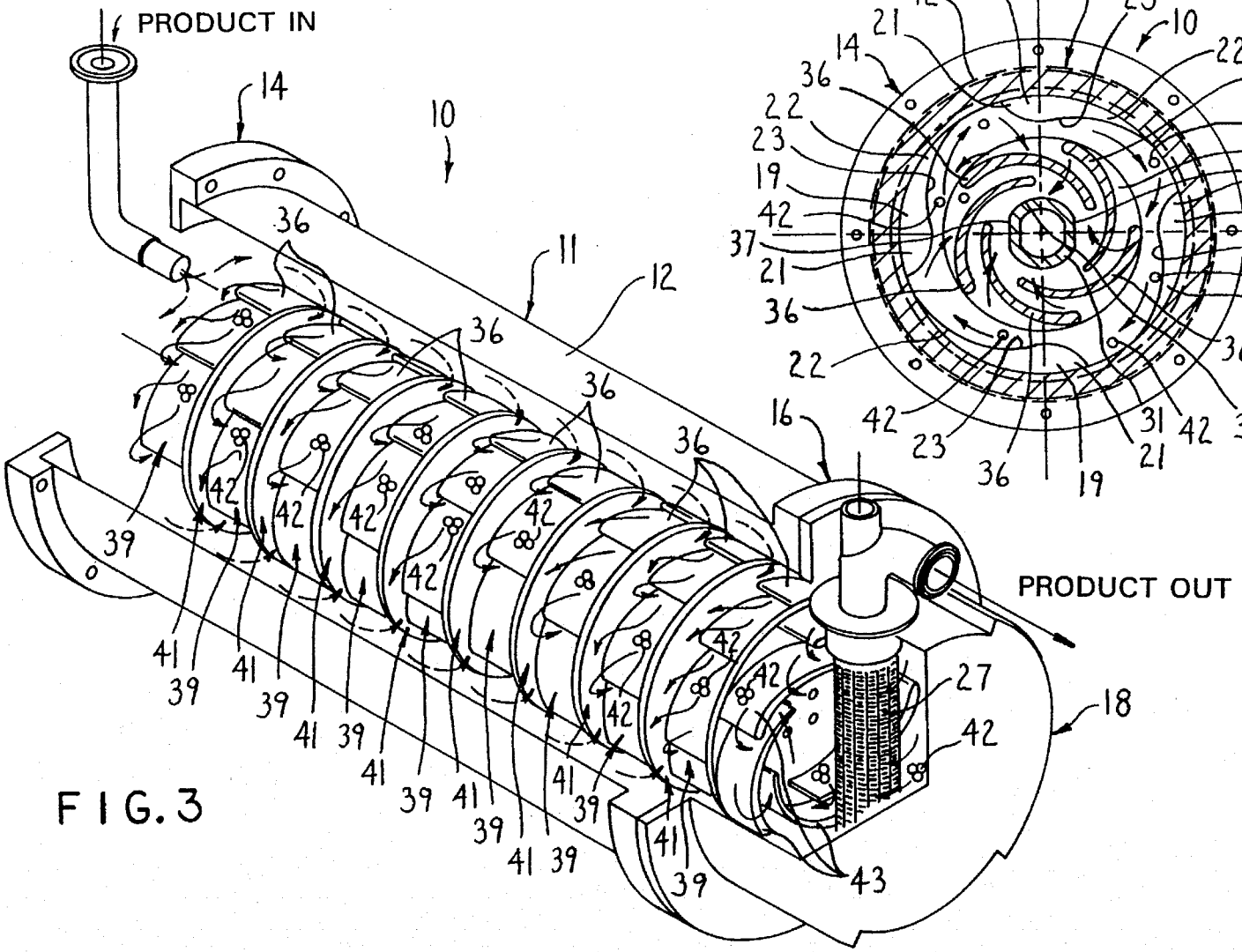
FIG. 3 is a further schematic isometric view of the mill illustrated in FIG. 1 but from an end opposite the inlet end shown in FIG. 2.

A continuous type mill 10 is illustrated in the drawings. The mill 10 includes a vessel 11 which includes a generally cylindrical wall 12 which is hollow so as to define a coolant fluid passageway 13 therein. The coolant passageway 13 has a coolant inlet and outlet as shown in FIG. 1. An end cap 14 is provided at the inlet (left) end of the vessel 11 and a further end cap 16 is provided at the outlet (right) end of the vessel 11. The end caps 14 and 16 enclose the ends of the cylindrical wall 12 so as to define an interior space 17 inside the vessel 11. The interior wall surface 18 of the cylindrical wall 12 is generally cylindrical and has a plurality of airfoil shaped media diverters 19 provided around the circumferential interior of the space 17. The cross sectional shape of the media diverters 19 are best illustrated in FIG. 4. In cross section, each diverter is identical to the other and includes a radially enlarging thick portion 21 located at one end of the diverter and a tapering thin portion 22 at the opposite end thereof. The radial thickness of the thick portion 21 is, in this embodiment, equal to 0.095 multiplied by the diameter of the wall surface 18. The radially inwardly facing surface 23 on each of the airfoil shaped diverters is smooth and continuous over the arcuate length of the diverter as shown in FIG. 4. The purpose of the diverters 19 will be explained in more detail below.

A product inlet port 24 is provided in the end cap 14 and facilitates the introduction of a particulate-containing substance under pressure from a pump (not shown) into the space 17 inside the vessel 11. The end cap 16 is provided with an outlet port 26 for the particulate-containing substance or product pumped through the space 17. In this particular embodiment, a filter screen 27 is provided in a housing 28 provided on the end cap 16 and is connected in fluid circuit with the outlet port 26, the interior of the housing 28 communicating with the interior space 17 in the vessel so that the particulate-containing substance or product can exit the vessel 11 through the filter screen 27 and product outlet port 26. The filter screen 27 is removably mounted on the housing 28 so that it can be removed from the housing and replaced with a further filter screen having a different mesh size or for the purpose of facilitating maintenance to the mill 10.

A rotor 29 is provided in the interior space 17 of the vessel 11. The rotor includes an elongated shaft 31 that is rotatably supported by any convenient means not illustrated. The shaft 31 is rotatably driven by a motor schematically illustrated at M in FIG. 1. In this particular embodiment, the shaft 31 is supported at only one end adjacent the end cap 14 and extends through an opening 32 in the end cap 14 whereat there is provided a conventional fluid seal 30 to prevent the leakage of liquid from the interior space 17 of the vessel between the internal diameter of the opening 32 and the exterior surface of the shaft 31. The shaft 31 terminates adjacent the filter screen 27 and has mounted on the length thereof in the space 17 of the vessel 11 a plurality of rotor blades 33. Each of the rotor blades 33 includes an annular disk 34 to which is secured a plurality of radially outwardly and arcuately formed blades 36. The blades 36 are, in this particular embodiment, integrally cast to the annular disk 34. On the other hand, each of the blades 36 can be individually formed and shaped and weldably secured to the annular disks 34. Each of the blades 36 is arcuately formed, as aforesaid, wherein the center point of the arc is spaced on an opposite side of the axis of rotation for the shaft 31 extending through the central portion of each of the annular disks 34. As shown in FIG. 4, the shaft 31 is flattened on diametrically opposite sides as at 37. Each of the annular disks 34 has a hole 38 through the central portion thereof which also includes flats that operatively engage the flats 37 on the shaft 31 so as to prevent the annular disks 34 from rotating or angularly moving relative to the shaft 31. The rotor disks 33 are spaced from one another by elongate and axially extending spacer bars 38 formed on the blades 36 as illustrated in FIG. 2. As a result, the rotor disks 33 can each be slid one after the other on to the shaft 31 with the spacer bars facing the inlet end of the vessel to cause the terminal ends of the spacer bars 38 on each of the blades 36, except for the rotor blade adjacent the inlet port 24, to engage a surface of an annular disk 34 facing the outlet end of the vessel 11. As a result, the regions radially aligned with the blades 36 each define a space 39 between a pair of mutually adjacent annular disks 34 and the regions defined by the spacer bars 38 define a further space 41 between the pair of mutually adjacent disks 34. The external diameter of the rotor disks 33 is less than the innermost surface of the thickest part of the diverters 19 as illustrated in FIG. 4. This spacing as well as the spacings 39 and 41 between the blades 36 and the internal surface 18 of the vessel 11 define a total space or volume within the vessel in which is housed comminuting media schematically represented at 42.

The shaft 31 illustrated in the drawings is shown to be hollow. The hollowness of the shaft allows a cooling fluid to be introduced into the interior of the shaft. In some instances, it may be desirable to make the shaft 31 solid.

The rotor disk 33 adjacent the end cap 16 includes on a side of the annular disk 34 facing the filter screen 27 a plurality of additional blades 43 which are similar in kind to the blades 36 except that the blades 43 are located on a side of the annular disk 34 facing the outlet port 26 or filter screen 27. The purpose of the blades 43 will be explained in more detail below.

OPERATION

Although a particular preferred embodiment of the invention has been described above, the following description of the operation is being provided for convenience.

Particulate-containing product is introduced or pumped into the inlet port 24 in the end cap 14. The broken line arrows in the drawings indicate product flow through the mill 10. The solid line arrows illustrate comminuting media flow. As the particulate-containing substance passes through the mill 10, it has a tendency to cause a migration of the media 42 toward the outlet port 26 causing a high density of the media 42 to exist around the filter screen 27. However, my invention provides a plurality of rotor disks 33 having a plurality of blades on each disk which radially fling the media outwardly toward the interior wall surface 18 of the vessel 11 and into engagement with the plural diverters 19. The diverters 19 divert the normal media movement to cause the media 42 to move to the space 41, whereat it is drawn radially inwardly and into the space 39 so that it can, in turn, be flung radially outwardly toward the interior wall surface 18 of the vessel 11. Such movement causes the media between a pair of mutually adjacent annular disks 34 to also flow axially toward the inlet port 24 and the end cap 14. This movement offsets any migration tendencies on the part of the media 42 toward the outlet port 26. As a result, a balanced distribution of the media 42 exists within the interior of the vessel 11. The blades 43 adjacent the filter screen 27 keep the media and particulate-containing substance constantly moving or agitated in the area adjacent the filter screen 27 so as to prevent a blockage or a hindering of the outflow of particulate-containing product through the filter screen 27 and thence the outlet port 26.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A continuous media mill for effecting in a particulate-containing substance a reduction in size of said particulate in said particulate-containing substance urged under pressure through said continuous media mill, comprising:

support means;

an elongated vessel means mounted on said support means, said vessel means having a generally cylindrical interior;

inlet means and outlet means in said vessel means for said particulate-containing substance;

comminuting media in the interior of said vessel means, said media having a tendency to migrate toward said outlet means with said pressurized particulate-containing substance moving from said inlet means toward said outlet means;

rotor means extending centrally of said cylindrical interior of said vessel means and along a majority of the length thereof, said rotor means having a diameter substantially less than an inner surface of said vessel means to define a first space therebetween, said rotor means including a plurality of blades spaced axially along the length thereof for flinging said media radially outwardly in response to a rotation of said rotor means and means for effecting a movement of said comminuting media toward said inlet means in response to a rotation of said rotor means to counter the aforesaid tendency of said media to migrate with said particulate-containing substance in said first space toward said outlet means.

2. The continuous media mill according to claim 1, wherein said rotor means further includes a rotatably driven shaft centrally disposed in said cylindrical interior of said vessel means and a plurality of flat, annular and parallel plates spaced axially along the length of said driven shaft so as to define a second space therebetween, each of said plates being adapted to rotate with said shaft, each of said plates being oriented in planes perpendicular to an axis of rotation of said driven shaft, a plurality of radially extending blades mounted on at least an axially facing side of each of said plates and in said second space and facing said inlet means, said blades having a width less than a width of said second space so as to define a third space between an axially facing edge of each of said blades and a mutually adjacent plate so that as a first portion of said media is flung radially outwardly by said blades, a second portion of said media, caused by said means for effecting a movement of said comminuting media toward said inlet means, is caused to move radially inwardly in said third space toward said shaft and thence axially into a radially inner part of said second space only to again be flung radially outwardly by said blades.

3. The continuous media mill according to claim 1, wherein plural diverter means are equally circumferentially spaced from each other on said interior surface of said vessel means in said first space for diverting media radially inwardly.

4. The continuous media mill according to claim 3, wherein each said diverter means are airfoil shaped in cross section having a large radial thickness at one circumferential end thereof and protruding radially inwardly from said interior surface and a smaller radially tapering thickness throughout a length thereof toward an opposite circumferential end thereof, only a radially inwardly facing surface of said airfoil being exposed to an interior of said vessel means, said media being flung radially outwardly into said first space eventually encountering said large radial thickness end of said airfoil and being diverted thereby radially inwardly into said third space.

5. The continuous media mill according to claim 1, wherein an axis of rotation of said rotor means and said cylindrical interior of said vessel means are each generally horizontally aligned.

6. The continuous media mill according to claim 1, wherein said rotor means is supported for rotation only at one end of said vessel means.

7. The continuous media mill according to claim 6, wherein said one end of said vessel means is adjacent said inlet means.

8. The continuous media mill according to claim 7, wherein said outlet means is oriented at an end of said vessel means remote from said inlet means.

9. The continuous media mill according to claim 8, wherein said outlet means includes a screen means for separating said media from said particulate-containing substance.

10. The continuous media mill according to claim 1, wherein said inlet means and said outlet means are oriented adjacent opposite ends of said cylindrical interior of said vessel means.

11. The continuous media mill according to claim 1, wherein said blades each have a finite axial width and a finite arcuate length extending from a radial inner end thereof to a radially outer end thereof, said radially outer ends each being forwardly spaced a finite distance in a direction of rotation of said rotor means from said radially inner end.

* * * * *